US005878731A

United States Patent [19]

Bedkowski

[11] Patent Number: 5,878,731

[45] Date of Patent: Mar. 9, 1999

[54] METHOD AND AN APPARATUS FOR CLEANING INTERNAL COMBUSTION ENGINE CRANKCASE BLOW-BY-GAS AND AN INTERNAL COMBUSTION ENGINE INCLUDING SAID APPARATUS

[75] Inventor: Maciej Bedkowski, Cambridgeshire, United Kingdom

[73] Assignee: Perkins Limited, United Kingdom

[21] Appl. No.: 945,119

[22] PCT Filed: May 22, 1996

[86] PCT No.: PCT/GB96/01210

§ 371 Date: Oct. 16, 1997

§ 102(e) Date: Oct. 16, 1997

[87] PCT Pub. No.: WO96/41933

PCT Pub. Date: Dec. 27, 1996

[30] Foreign Application Priority Data

Jun. 9, 1995 [GB] United Kingdom ..... 9511804

[51] Int. Cl.[6] ..... F01M 13/00

[52] U.S. Cl. ..... 123/573

[58] Field of Search ..... 123/572, 573, 123/574

[56] References Cited

U.S. PATENT DOCUMENTS

| | | | |
|---|---|---|---|
| 2,057,001 | 10/1936 | Bogdany et al. . | |
| 3,533,385 | 10/1970 | Bennett . | |
| 3,828,744 | 8/1974 | Hollins . | |
| 4,269,607 | 5/1981 | Walker | 123/573 |
| 4,724,807 | 2/1988 | Walker . | |
| 4,945,887 | 8/1990 | Sakkurai et al. | 123/573 |
| 5,140,957 | 8/1992 | Walker . | |
| 5,329,913 | 7/1994 | Suzuki et al. . | |
| 5,542,402 | 8/1996 | Lee et al. | 123/573 |

FOREIGN PATENT DOCUMENTS

| | | |
|---|---|---|
| 2332424 | 6/1977 | France . |
| 61-171814 | 8/1986 | Japan . |
| 5044424 | 2/1993 | Japan . |

*Primary Examiner*—Marguerite McMahon
*Attorney, Agent, or Firm*—Nilles & Nilles

[57] ABSTRACT

An internal combustion engine in which the oil content of blow-by gas is reduced by conveying the blow-by gas (34) away from the engine to be cooled in a heat exchanger (30). Oil (40) condensing from the cooled blow-by gas (34) is returned to the engine and the cooled blow-by gas is exhausted to atmosphere or conveyed to the engine air intake system.

24 Claims, 4 Drawing Sheets

METHOD AND AN APPARATUS FOR CLEANING INTERNAL COMBUSTION ENGINE CRANKCASE BLOW-BY-GAS AND AN INTERNAL COMBUSTION ENGINE INCLUDING SAID APPARATUS

BACKGROUND OF THE INVENTION

The present invention relates to a method and an apparatus for cleaning internal combustion engine crankcase blow-by gas and an internal combustion engine including said apparatus.

1. Field of the Invention

During the compression and power strokes in an internal combustion engine, the difference in gas pressures above and below a piston is sufficient to cause leakage (blow-by) of gas past the piston into the engine crankcase. The resulting increase in pressure within the crankcase can cause oil to pass by the engine oil seals and this pressure may also damage the seals.

To diminish the damaging effects of blow-by it is normal to relieve crankcase pressure by either venting the blow-by gas to atmosphere via an open breather or by connecting the crankcase to the engine intake air system whereby blow-by gas is conveyed to the air intake system and thence to the combustion chamber under the control of a pressure regulating valve. The pressure regulating valve maintains gas pressure within the crankcase between desirable limits. This latter arrangement constitutes a closed-circuit breather system.

The blow-by gas carries with it oil vapour and this exits the engine to atmosphere via the open breather or, in the closed-circuit breather system, is taken into the engine air inlet system and is partially or fully burned before exiting to atmosphere via the engine exhaust system. In either case, this results in undesirable emissions being emitted which contain either unburned oil or the products of burned oil. The oil content of the blow-by gas, where this is fed into the engine intake air system via a closed-circuit breather system, also leads to fouling of turbo-charger compressor vanes, engine poppet valves and other components in contact with inlet air.

2. Description of the Related Art

U.S. Pat. No. 3,533,385 and JP-A-61-171814 each disclose an apparatus for reducing the oil content of blow-by gas in an internal combustion engine, comprising: means for conveying blow-by gas away from the engine crankcase to a heat exchanger cooled by air from an engine air intake system, said blow-by gas being cooled by passing it through the heat exchanger; means for returning oil condensed from said cooled blow-by gas to the engine; and means for directing the cooled blow-by gas into the flow of engine inlet air, said means comprising a blow-by gas outlet.

In the case of U.S. Pat. No. 3,533,385, the blow-by gas outlet is located internally of the heat exchanger but is not adjacent to an air inlet end of the heat exchanger.

In the case of JP-A-61-171814, the blow-by gas outlet is external of the heat exchanger.

OBJECTS AND SUMMARY OF THE INVENTION

It is an object of the present invention to provide a method of reducing oil content of blow-by gas in an internal combustion engine.

It is a further object of the present invention to provide an apparatus for reducing oil content of blow-by gas in an internal combustion engine.

A yet further objective is to provide a means for the recovery of lubricating oil which would otherwise be lost to atmosphere or burned in the engine combustion chamber.

According to one aspect of the present invention, there is provided a method of reducing the oil content of blow-by gas in an internal combustion engine, comprising the steps of: conveying blow-by gas away from the engine crankcase to a heat exchanger cooled by air from an engine air intake system; cooling said blow-by gas by passing it through said hear exchanger; returning oil condensed from said cooled blow-by gas to the engine; and directing said coled blow-by gas into the flow of engine inlet air via a blow-by gas outlet located internally of the heat exchanger, characterised in that said blow-by gas outlet is located adjacent to an air inlet end of said heat exchanger.

According to a second aspect of the present invention, there is provided an apparatus for reducing the oil content of blow-by gas in an internal combustion engine, comprising: means for conveying blow-by gas away from the engine crankcase to a heat exchanger cooled by air from an engine air intake system, said blow-by gas being cooled by passing it through the heat exchanger; means for returning oil condensed from said cooled blow-by gas to the engine; and means for directing the cooled blow-by gas into the flow of engine inlet air, said means comprising a blow-by gas outlet, located internally of the heat exchanger, characterised in that said blow-by gas outlet is located adjacent to an inlet air end of said heat exchanger.

Further features of the method and apparatus of the invention are in accordance with the appended claims.

According to a third aspect of the present invention there is provided an internal combustion engine incorporating an apparatus in accordance with the second aspect of the invention.

BRIEF DESCRIPTION OF THE DRAWINGS

The foregoing and further features of the present invention will be more readily understood from the following description of a preferred embodiment, by way of example thereof, with reference to the accompanying drawings, of which.

DESCRIPTION OF THE PREFERRED EMBODIMENTS

Figure 1:
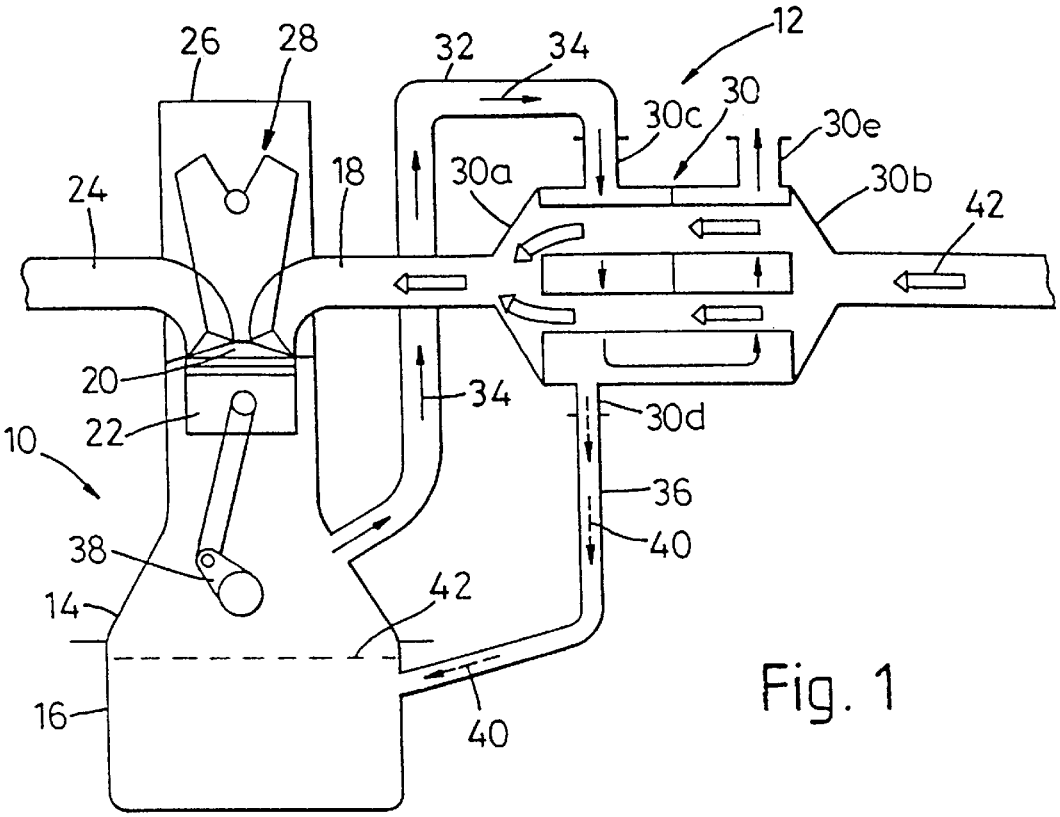
FIG. 1 is a schematic illustration of an internal combustion engine including an apparatus for reducing the oil content of blow-by gas.

Referring to the drawings, FIG. 1 is a schematic illustration of an internal combustion engine 10 including an apparatus 12 for cleaning crankcase blow-by gas. The internal combustion engine 10 is of the overhead camshaft type and has a crankcase 14, an oil sump 16, an inlet air manifold 8 for conveying air to a combustion chamber 20 disposed above a piston 22, an exhaust manifold 24 for conveying exhaust gas away from said combustion chamber 20 and a rocker arm housing 26 containing a rocker arm and camshaft arrangement 28.

The apparatus 12 for cleaning blow-by gas comprises a heat exchanger 30 located in the engine air intake system with its air outlet 30*a* connected to the engine air manifold 18 and its inlet 30*b* connecting with an outlet of an air filtering means (not shown) of said air intake system. The apparatus 12 also includes a pipe 32 for conveying blow-by gas 34 from the engine crankcase 14 to a blow-by gas inlet 30*c* of the heat exchanger 30 and an oil return pipe 36 connecting the oil sump 16 with an oil outlet 30*d* of said heat exchanger 30. The heat exchanger 30 also includes a blow-by gas outlet 30*e*.

During engine operation, oil within the engine sump 16 becomes hot and due to mechanical agitation by rotation of the crankshaft 38 some of the oil exists as a hot mist/vapour coating engine components within the crankcase 14 and contaminating blow-by gas which leaks into the crankcase 14. The blow-by gas increases pressure within the crankcase 14 and ordinarily this pressure would be released by exhausting the gas to atmosphere through an open breather or alternatively conveying said gas to the engine air inlet manifold under the control of a pressure regulating means.

The blow-by gas from the crankcase 14 is conveyed to the heat exchanger 30 where it is cooled. Cooling of the blow-by gas causes some of the oil vapour contained therein to condense and the condensed oil 40 is collected and returned to the engine 10. The oil 40 is returned to the engine sump 16 by the oil return pipe 36 and enters said sump 16 below the oil level 42. The "cleaned" blow-by gas is exhausted to atmosphere.

It will be appreciated that the heat exchanger 30 can be cooled by any suitable cooling agent, but it is preferred that the heat exchanger 30 is cooled by air 42 from the engine air inlet system thus providing a simple and inexpensive method of cooling the blow-by gas.

Figure 2:
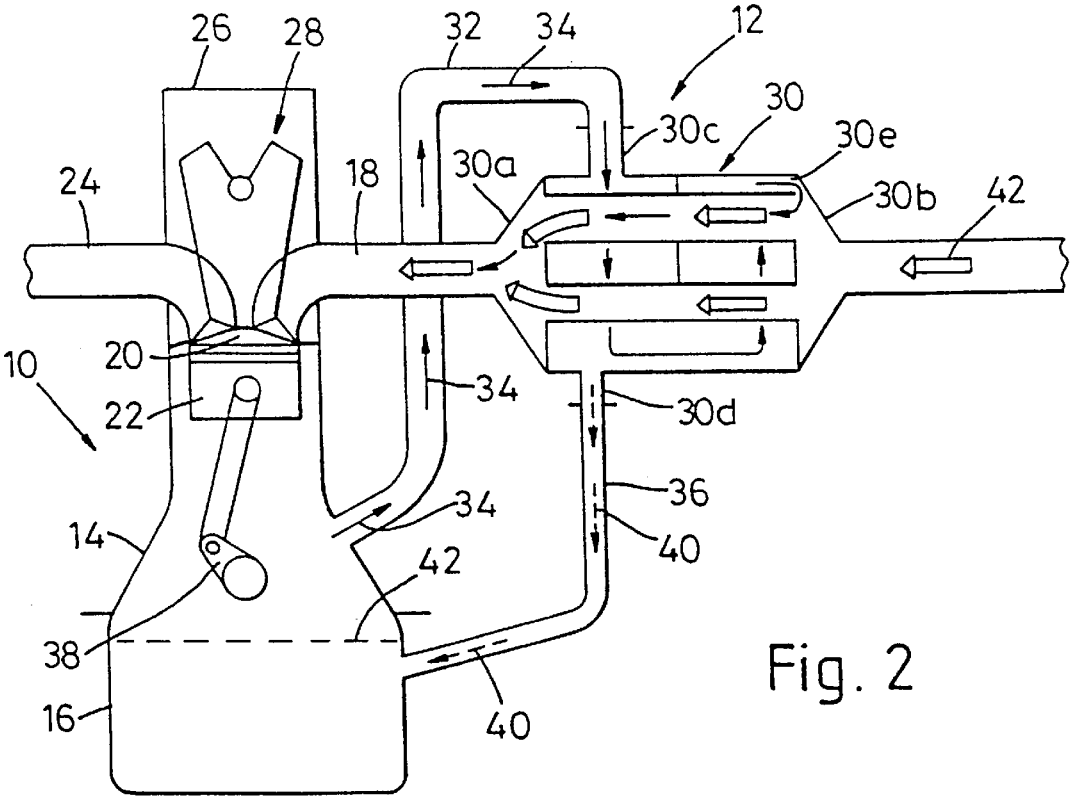
FIG. 2 is a schematic illustration of an internal combustion engine including an apparatus in accordance with a preferred embodiment of the present invention.

FIG. 2 is a schematic illustration of an internal combustion engine including an apparatus in accordance with a preferred embodiment of the present invention. In the following description, like numerals will be used to denote like parts.

This embodiment differs from that illustrated in FIG. 1 insofar that the blow-by gas outlet 30*e* of the heat exchanger 30 is internal to the heat exchanger 30 and directs cooled blow-by gas into the engine inlet air flow. Thus, the blow-by gas once cleaned is directed to the engine combustion 20 chamber for combustion of any oil remaining in the cooled blow-by gas and, equally importantly, combustion of any uncombusted fuel products contained within said gas. Thus, emissions from the engine 10 due to burning of oil contained within blow-by gas is dramatically reduced.

Both of the embodiments hereinbefore described also have the advantage of recovering a substantial proportion of oil 40 which would ordinarily be lost in the blow-by gas. It has surprisingly been found that by cooling the blow-by gas in the manner proposed an oil recovery rate of up to 70% can be achieved.

Figure 3:
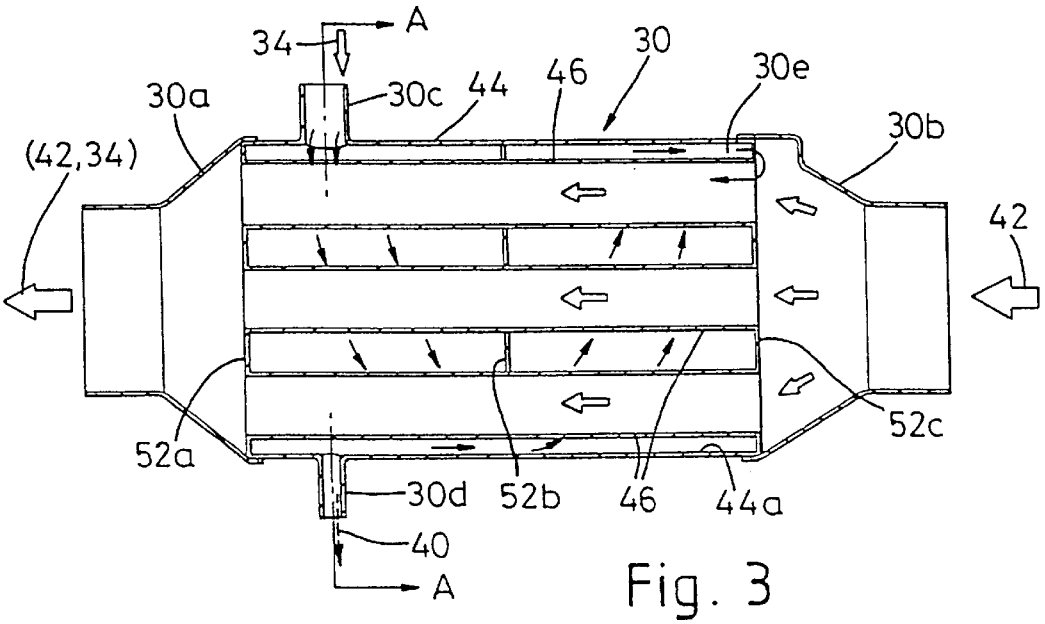
FIG. 3 is a longitudinal-sectional view in a vertical plane of a heat exchanger for use in the apparatus of the preferred embodiment of the invention.
Figure 4:
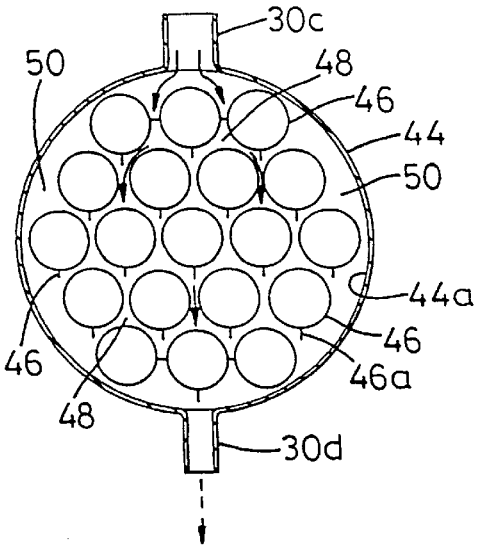
FIG. 4 is a cross-sectional view on vertical section line A—A of FIG. 3 illustrating the arrangement of tubular members within a housing of the heat exchanger.
Figure 5:
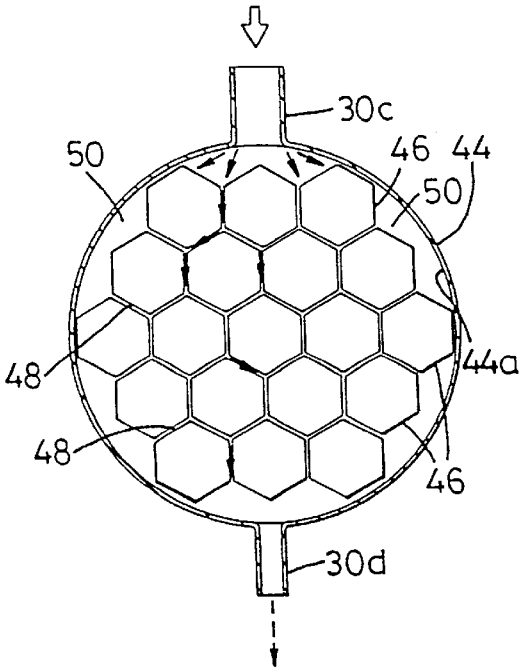
FIG. 5 is a cross-sectional view on vertical section line A—A of FIG. 3 showing a similar arrangement to that of FIG. 4 of alternative tubular members within the housing of the heat exchanger.

FIG. 3 illustrates an preferred form of the heat exchanger 30 for use in the apparatus according to the invention. This comprises a generally cylindrical housing 44 containing a plurality of tubular members 46 which are arranged spaced apart in side-by-side relation with their longitudinal axes parallel with the longitudinal axis of the housing 44. The tubular members 46 are spaced within the housing 44 so as to provide gaps 48 (FIGS. 4 and 5) therebetween and an outer space 50 (FIGS. 4 and 5) between them and an inner wall 44*a* of the housing which together with partition plates 52(*a,b,c*) which divide the space 50 define a flow path for blow-by gas between the blow-by gas inlet 30*c* and blow-by gas outlet 30*e* of the heat exchanger 30. The tubular members 46 collectively define a flow path for the cooling agent which, in the preferred embodiment, comprises air from the engine inlet air system.

In the preferred embodiment, it will be seen that blow-by gas 34 entering the blow-by gas inlet 30*c* of the heat exchanger 30 is forced to flow over the outer surfaces of first ends of the tubular members 46 generally downwardly before rising over second ends of the tubular embers 46 towards the blow-by gas outlet 30*e*. The tubular members 46 are cooled by the air 42 from the engine inlet air system flowing through them. Consequently, the blow-by gas, which is at a temperature of approximately 70° C. on entry to the heat exchanger 30, is cooled to about 20° C. during its passage between the blow-by gas inlet 30*c* and outlet 30*e*. This results in a substantial proportion of oil vapour contained within said blow-by gas condensing within the housing 44. The condensed oil collects in a base of the housing 44 before draining via the oil drainpipe 36 back to the engine sump 16. The blow-by gas outlet 30*e* directs cooled blow-by gas into the inlet air flow to be carried to the engine inlet manifold for combustion.

The heat exchanger is arranged such that blow-by gas is generally forced to flow in a direction opposite to that of cooling air from the engine inlet air system and the length of the blow-by gas flow path is substantially greater than the length of the flow path of cooling air from the engine air cooling system. The tubular members 46 may be circular (FIG. 4) in cross-section some of which may include a fin 46*a* to increase the heat transfer surface area of the blow-by gas flow path. Preferably, the tubular members 46 are hexagonal and are arranged such that the gaps 48 therebetween are of constant width thus defining a plurality of minor flow paths for blow-by gas.

Figure 6A:
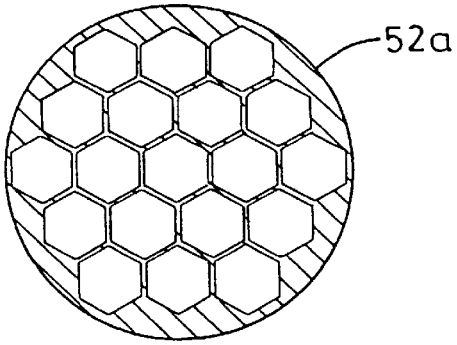
FIGS. 6*a* to *c* are plan views of partition plates for the heat exchanger of FIG. 3 incorporating the tubular member arrangement of FIG. 5.
Figure 6B:
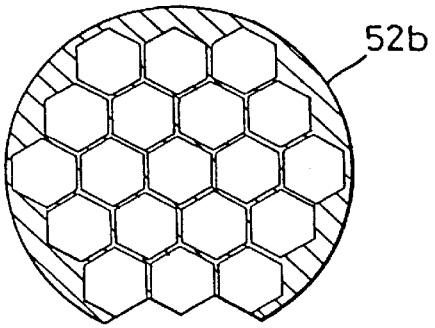
Figure 6C:
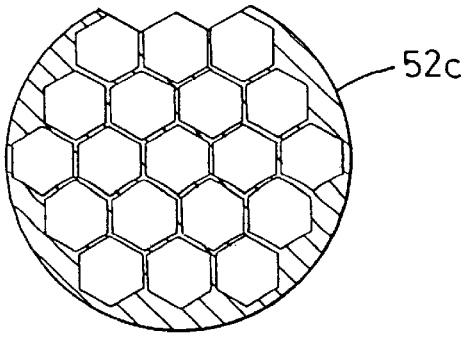

The partition plates 52(*a,b,c*) are arranged so as to secure the tubular members 46 in their spaced apart side-by-side relationship and are placed within the housing 44 in order to divide the internal space 50 to define around the exteriors of the tubular members 46 the flow path for the blow-by gas. It can be seen that plates 52(*b,c*) have respective cutaway sections comprising part of the blow-by gas flow path. Thus, where the tubular members are hexagonal in cross-section, the partition plates have a honeycomb arrangement as illustrated if FIGS. 6*a* to 6*c*.

Figure 7:
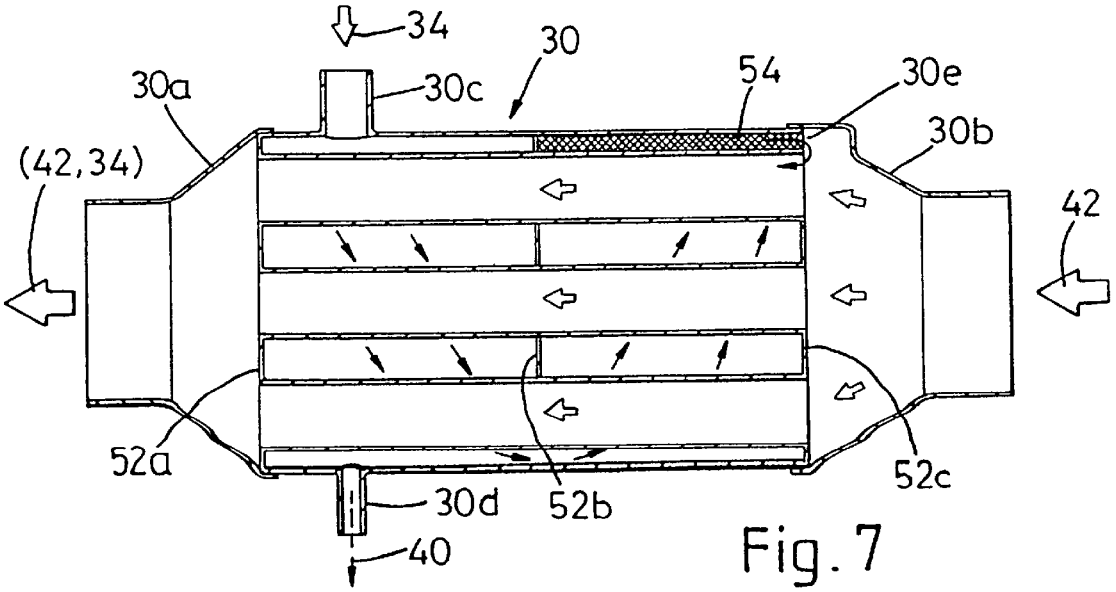
FIG. 7 is a longitudinal-sectional view in a vertical plane of a second embodiment of a heat exchanger.

To increase yet further oil recovery from the blow-by gas, a mesh material 54 (FIG. 7) may be located at least adjacent the blow-by gas outlet 30*e* of the heat exchanger 30 in order to "filter" any oil droplets being carried toward said outlet 30*e* by the blow-by gas. the blow-by gas.

Figure 8:
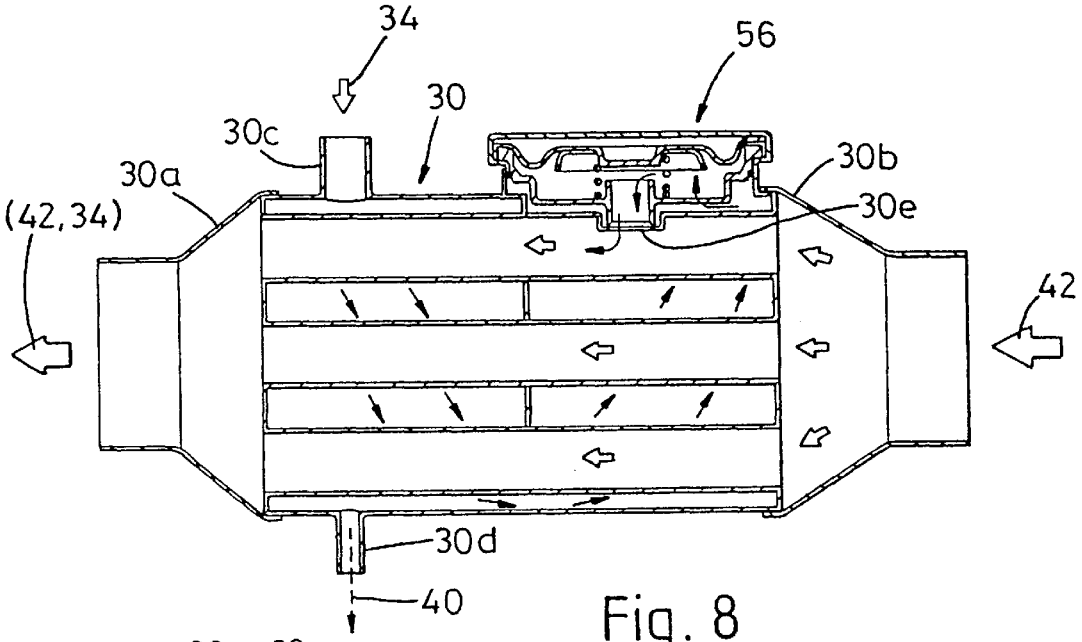
FIG. 8 is a longitudinal-sectional view in a vertical plane of a third embodiment of a heat exchanger.
Figure 9:
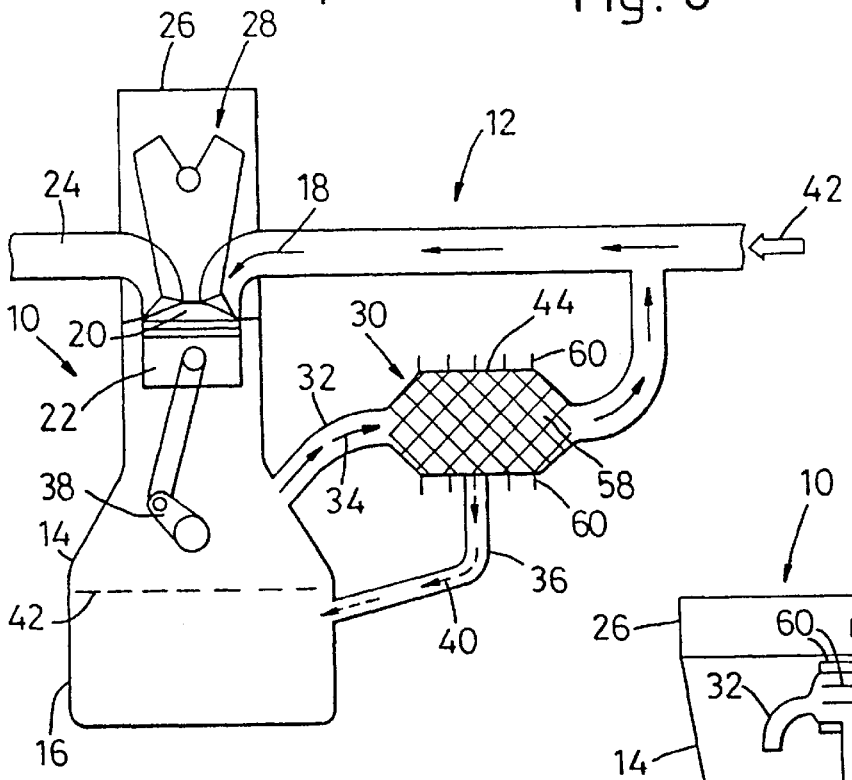
Figure 10:
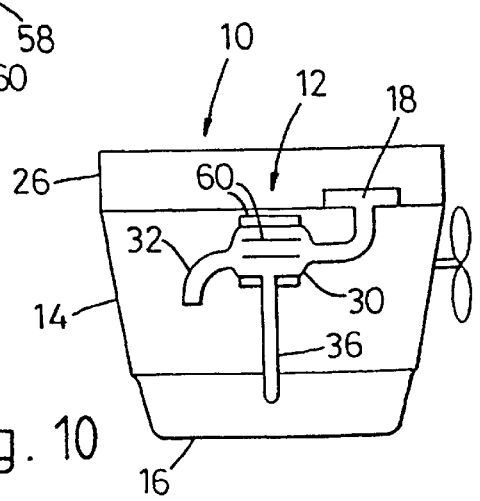

The heat exchanger may incorporate a sump pressure regulating valve 56 (FIG. 8) which avoids the need for installation of a pressure regulating means elsewhere on the engine 10.

It will be appreciated that the features of the second (FIG. 7) and third (FIG. 8) embodiments of the heat exchanger can be incorporated together in a single heat exchanger for use in the apparatus according to the invention.

It will also be appreciated that a heat exchanger comprising a part of the apparatus of the present invention can take many forms and can be cooled by any suitable cooling agent. For example, it is envisaged that with a marine engine the cooling agent will be sea water.

I claim:

1. A method of reducing the oil content of blow-by gas in an internal combustion engine, comprising the steps of: conveying blow-by gas (34) away from the engine crankcase (14) to a heat exchanger (30) cooled by air (42) from an engine air intake system; cooling said blow-by gas (34) by passing it through said heat exchanger (30); returning oil condensed from said cooled blow-by gas (34) to the engine (10); and directing said cooled blow-by gas (34) into the flow of engine inlet air via a blow-by gas outlet **(30*e*) which is located internally of the heat exchanger (30), characterised in that said blow-by gas outlet (30*e*) is located adjacent to an air inlet end (30*b*) of said heat exchanger (30)**.

2. A method as claimed in claim 1, characterised in that the cooled blow-by gas (34) is directed into the flow of engine inlet air (42) in a direction generally opposite to a direction of flow of said inlet air.

3. A method as claimed in claim 1, characterised in that the blow-by gas (34) is forced to flow through the heat exchanger (30) in a direction generally opposite to the direction of cooling air (42) flowing through said heat exchanger (30).

4. A method as claimed in claim 1, characterised in that it includes directing the cooled blow-by gas (34) into the engine inlet air flow (42) on an engine side of an air filtering means of the engine air intake system.

5. A method as claimed in claim 1, characterised in that it includes forcing the blow-by gas (34) to flow over the outer surfaces of a plurality of tubular cooling members (44) mounted within the heat exchanger (30), the tubular members (46) being cooled b the air (42) from the engine air intake system flowing through them.

6. A method as claimed in claim 5, characterised in that it includes forcing the blow-by gas (34) to flow over the outer surfaces of first ends of said tubular members (46) before flowing over the outer surfaces of second ends of said members (46).

7. A method as claimed in claim 1, characterised in that it includes regulating the pressure of the blow-by gas (34) by means of a pressure regulating valve (56) incorporated in the heat exchanger (30).

8. A method as claimed in claim 1, characterised in that it includes passing the blow-by gas (34) through a mesh material (54) located in the blow-by gas flow path adjacent to the blow-by gas outlet **(30*e*)**.

9. A method as claimed in claim 1, characterised in that it includes the step of returning oil condensed from said cooled blow-by gas (34) to the engine sump (16).

10. A method as claimed in claim 1, characterised in that it includes returning oil condensed from said cooled blow-by gas (34) to a position in the sump (16) below the normal engine oil level.

11. An apparatus for reducing the oil content of blow-by gas in an internal combustion engine, comprising: means for conveying blow-by gas (34) away from the engine crankcase (14) to a heat exchanger (30) cooled by air (42) from an engine air intake system, said blow-by gas (34) being cooled by passing it through the heat exchanger (30); means (36) for returning oil condensed from said cooled blow-by gas (34) to the engine (10); and means **(30*e*) for directing the cooled blow-by gas (34) into the flow of engine inlet air (42), said means (30*e*) comprising a blow-by gas outlet (30*e*) located internally of the heat exchanger (30), and characterised in that said blow-by gas outlet (30*e*) is located adjacent to an inlet air end (30*b*) of said heat exchanger (30)**.

12. An apparatus as claimed in claim 11, characterised in that the blow-by gas outlet **(30*e*) is arranged such that it directs cooled blow-by gas (34) into the flow of engine inlet air (42)** in a direction generally opposite to a direction of flow of said inlet air.

13. An apparatus as claimed in claim 11, characterised in that the heat exchanger (30) is arranged such that blow-by gas (34) is forced to flow through the heat exchanger (30) in a direction generally opposite to the direction of cooling air (42) flowing through said heat exchanger (30).

14. An apparatus as claimed in claim 11, characterised in that the heat exchanger (30) is arranged on an engine side of an air filtering means of the engine air intake system.

15. An apparatus as claimed in claim 11, characterised in that the oil return means (36) returns condensed oil to a sump (16) of the engine (10).

16. An apparatus as claimed in claim 15, characterised in that the oil return means (36) returns condensed oil to a position on the engine sump (16) below a normal engine oil level.

17. An apparatus as claimed in claim 11, characterised in that it includes a pressure regulating valve (56) incorporated in the heat exchanger (30), said valve (56) being arranged to regulate the pressure of blow-by gas (34) being conveyed to the heat exchanger (30) from the engine crankcase (14).

18. An apparatus as claimed in claim 11, characterised in that the heat exchanger (30) comprises a housing (44) containing at least one tubular member (46) arranged with its longitudinal axis parallel with the longitudinal axis of the housing, said at least one tubular member (46) defining a flow path for the cooling air (42), and an inlet **(30*c*) for blow-by gas which communicates with space (50) surrounding said at least one tubular member (46) and partition plates (52) which divide said space (50) to define a flow path for the blow-by gas (34) extending from said blow-by gas inlet (30*c*) to the blow-by gas outlet (30*e*) located internally of the heat exchanger (30)**.

19. An apparatus as claimed in claim 18, characterised in that the heat exchanger (30) includes a plurality of tubular members (46) arranged spaced apart in side by side relationship within the housing (44).

20. An apparatus as claimed in claim 19, characterised in that the tubular members (46) are circular in cross-section.

21. An apparatus as claimed in claim 19, characterised in that each tubular member (46) includes a fin **(46*a*) extending from its outer surface, the fin (46*a*) acting as an additional heat transfer means for cooling the blow-by gas (34)**.

22. An apparatus as claimed in claim 19, characterised in that the tubular members (46) have a polygonal cross-section.

23. An apparatus as claimed in claim 18, characterised in that the heat exchanger (30) includes a mesh material (54) located in the blow-by gas flow path adjacent to at least the blow-by gas outlet **(30*e*)**.

24. An internal combustion engine including an apparatus in accordance with claim 11.

* * * * *